United States Patent [19]

Crawford

[11] Patent Number: 4,517,498

[45] Date of Patent: May 14, 1985

[54] SEQUENCE START LAMP BALLAST WITH CURRENT SPIKE SUPPRESSION MEANS

[75] Inventor: Joseph A. Crawford, Cook County, Ill.

[73] Assignee: Advance Transformer Co., Chicago, Ill.

[21] Appl. No.: 351,192

[22] Filed: Feb. 22, 1982

[51] Int. Cl.[3] ..... H05B 37/00; H05B 39/00; H05B 41/00

[52] U.S. Cl. ..... 315/323; 315/71; 315/74; 315/91; 315/231; 315/239; 315/DIG. 5

[58] Field of Search ..... 315/47, 53, 71, 74, 315/91, 122, 177, 187, 188, 232, 239, 323, DIG. 5, 231

[56] References Cited

U.S. PATENT DOCUMENTS 3,911,320 10/1975 Crawford et al. ..... 315/187
4,435,670 3/1984 Evans et al. ..... 315/177

*Primary Examiner*—William L. Sikes
*Assistant Examiner*—Robert E. Wise
*Attorney, Agent, or Firm*—Silverman, Cass & Singer, Ltd.

[57] ABSTRACT

A ballast for a sequence start series operating circuit that includes two rapid start gaseous discharge lamps. The circuit includes a transformer with a primary winding and a loosely coupled secondary winding, a series first capacitor for providing a leading current when both lamps have been ignited and are operating and a second capacitor shunting the second-to-ignite lamp to by-pass that lamp during ignition of the first-to-ignite lamp and thereafter to develop a voltage across the second capacitor sufficient to ignite the second-to-ignite lamp when current flows in the by-pass branch. The lamps are of a variety which produces an undesirable current peak in the second-to-ignite lamp on each half cycle because the shunting second capacitor dumps its charge accumulated during each half cycle into the lamp. The secondary winding is made up of a main part and an auxiliary part, the auxiliary part being connected in series with the second capacitor in the by-pass branch so that an inductive reactance is added to the capacitance in that branch for suppressing the current peak in the second-to-ignite lamp on each half cycle. The auxiliary part of the secondary winding does not participate in the ignition of the first-to-ignite lamp but it does participate voltage-wise in the operation of both lamps in series.

23 Claims, 8 Drawing Figures

SEQUENCE START LAMP BALLAST WITH CURRENT SPIKE SUPPRESSION MEANS

BACKGROUND OF THE INVENTION

This invention is concerned with a ballast for igniting and operating two rapid start fluorescent lamps from a relatively low voltage source.

Rapid start lamps are in wide spread use at the present time because they are reliable, efficient and furnish good illumination for the energy they consume. They are oftentimes preferred to the so-called instant start types of lamps because they start and operate at lower voltages. This is accomplished by the use of rugged filaments in the lamps which are energized at all times that the lamps are operating.

The typical two-lamp rapid start circuit includes a ballast which furnishes the igniting and operating voltage in a manner known as series-sequence. The circuit provides for the starting of the lamps in sequence so that they do not require the sum of the starting voltages to start them. Once the lamps have been ignited they operate in series and a condenser is provided for achieving leading current in the circuit for preferred power factor effects.

A typical rapid start arrangement has a pair of 48 inch T-12 rapid start lamps of 40 watt rating mounted in a single metal fixture connected into a 120 volt 60 hertz source of power. The ballast has a primary winding and a secondary winding which may be connected in autotransformer or straight transformer relationship so that all or a part or none of the primary winding is used in the operation of the lamps and their starting. The second-to-ignite lamp is shunted by a capacitor so that on open circuit all of available voltage is across the first-to-ignite lamp, by-passing the second-to-ignite lamp. As soon as the first-to-ignite lamp is ignited and current flows in the circuit, the shunting capacitor acquires a voltage which is high enough to ignite the second lamp. The impedance of the second-to-ignite lamp being much lower than the reactance of the shunting capacitor, current prefers to pass through the lamp than the shunting capacitor. As a result, the effect is to exclude the shunting capacitor from the operating circuit. As will be seen from the discussion which follows, the shunting capacitor will produce undesirable effects under certain circumstances, which must be alleviated.

When both lamps are ignited the circuit includes the connected windings of the transformer and the series capacitor which played no role in the starting of the lamps other than to enable the voltage effect of the windings on open circuit to be applied across the first-to-ignite lamp. The connected windings may include the secondary winding only, the secondary and primary windings if they are connected in autotransformer relationship or the secondary winding with a part of the primary winding which is connected thereto in autotransformer relationship.

The ballasting effect, that is, the development of sufficient inductance in the circuit to prevent the lamps from passing large currents on igniting (since the lamps are negative resistance characteristic gaseous discharge devices whose impedances drop radically when they ignite) is achieved normally by loosely coupling the secondary winding relative to the primary winding. This is achieved by means of shunts and/or physical separation of the windings. The core of the transformer will usually have one or more bridged air gaps to improve wave shape and prevent saturation in the winding leg under the secondary winding where the slots are normally located.

Typical prior art patents which are directed to the field of the invention and disclose rapid start ballasts including their circuitry are:

Feinberg—Pat. No. 2,820,180
Feinberg—Pat. No. 2,900,577
Feinberg et al—Pat. No. 3,195,012
Hume—Pat. No. 3,225,255
Colliton—Pat. No. 4,185,231

Some of the techniques of these prior art patents are used in the circuitry of the invention including isolating the primary and secondary windings for safety and providing means for aiding in the starting of the lamps through the use of the grounded metal fixtures providing an additional voltage through the use of a resistor to ground in circuit with the primary winding.

Recent practice in the lighting industry has tended toward the use of lamps which are intended to save energy by being operated under conditions somewhat different than heretofore. Such conditions include lower currents which reduces the power consumption. Lamps which are built for nominal ratings of a given value are operated at lower ratings in the effort to save power.

The most popular type of rapid start lamp in use today is the 40 watt T-12 48 inch lamp and the most frequently used ballast circuit is one in which the primary winding and secondary winding are connected in autotransformer relationship so that the primary voltage is available, not only to assist in the starting of the first-to-ignite lamp but also to provide voltage for maintaining operation of both lamps in series. This type of ballast is very economical and considered relatively safe; hence when utilized with a line voltage of 120 volts it is not considered necessary to provide isolation between the primary and secondary windings. The minimum peak voltage to ground at the lamp sockets is 180 volts RMS. The capacitor which is used for the shunting circuit around the second-to-ignite lamp is almost invariably a 0.05 microfarad capacitor because the capacitance of 0.06 microfarad has been established by insurance testing laboratories as the maximum safe value. Accordingly there need not be a bleed resistor connected across a capacitor of this capacitance or less because the maximum discharge from such a capacitor is not considered to be harmful.

The energy saving lamps of recent times operate at lower wattages of 34 and 35 and are adapted for use with the same ballasts that have been designed for 40 watt lamps. Their arc voltages are less than those of the conventional 40 watt rapid start lamps so they consume less power. Some manufacturers of ballasts have constructed ballasts specifically for the lower wattage lamps but the construction differs very little from that of the ordinary two lamp series-sequence rapid start ballasts for 40 watt lamps.

The lamps with which the invention is concerned are intended for use under circumstances which normally would call for 40 watt lamps and in fact prior to the present period of time 40 watt lamps would have been used. The lamps involved are of a new type that have a power rating of 32 watts. These lamps are of smaller diameter than the normal T12 40 watt lamp, being known as T-8 lamps which are 1 inch in diameter. They are of the rapid start type and are at the present time being manufactured by GTE Products Corporation, Sylvania Lighting Center, Danvers, Mass. and are offered under the trademark "Octron". The manufacturer states that these lamps have an efficiency of 90 lumens per watt compared with 78 lumens per watt for most ordinary fluorescent lamps. The color is considered desirable in that the lamps have a Color Rendering Index (CRI) of 75 compared to CRI's of 62 and less for other fluorescent lamps.

Certain problems arise in connection with igniting and operating these lamps which will be described presently and which are solved by the invention.

The 32 watt rapid start lamps require higher igniting and operating voltages than the ordinary 40 watt lamps; hence the usual 40 watt rapid start ballast for two sequence-start lamps will not be suitable for igniting the 32 watt lamps or maintaining them in operation. The igniting voltage for the 32 watt rapid start lamp is 300 volts while the igniting voltage for the normal 40 watt rapid start lamp is substantially less. A conventional two lamp 40 watt rapid start ballast will not ignite the 32 watt "Octron" lamps. The resulting requirements for voltage and capacitance of the shunting capacitor produce conditions which result in a transformer that must generate higher voltages and a circuit which will consequently provide higher igniting voltages.

The 40 watt rapid start ballast of conventional construction utilizes a 0.05 microfarad shunting capacitor to aid in starting the second-to-ignite lamp. The economy of not being required to connect a bleed resistor across a capacitor of this capacitance together with the fact that adequate starting voltage for the second-to-ignite lamp of about 250 volts RMS is developed in the capacitor has made the 40 watt ballast very popular. In addition, the currents in the series operated lamps are well-balanced and there are no high current pulses or spikes in the second-to-ignite lamp during operation which could damage that lamp.

Aside from the fact that higher voltages are needed than generated in the normal 40 watt rapid start ballast for two lamps, the conventional circuitry is not suitable for "Octron" lamps because of an important reason. The manufacturer of the lamps specifies the need for a 0.1 microfarad capacitor shunting the second-to-ignite lamp in order to achieve a sufficient voltage across the capacitor to ensure ignition of the second-to-ignite lamp. At the same time the manufacturer specifies the maximum peak current that the 32 watt rapid start lamp will pass without damaging the cathodes.

In the case of the 32 watt T-8 fluorescent lamp mentioned above a problem has arisen in the use of the 0.1 microfarad capacitor in that a very high current spike accompanies the ignition of the second-to-ignite lamp on each half cycle of the alternating current. This spike is apparently caused by the fact that the T-8 lamp ignites so rapidly each half cycle that whatever charge has been accumulated in the shunting capacitor during the previous half cycle is suddenly "dumped" into the branch circuit which it is shunting and which comprises, of course, the second-to-ignite lamp. This spike passes through the filaments of the lamp and will eventually destroy them in a shorter time than warranted by the manufacturer. Thus, the manufacturer has limited the peak current to be passed by requiring that any ballast circuit which is used to operate the lamp must produce a crest factor current wave shape including this spike which does not exceed 1.7. As stated above, the manufacturer also requires that the shunting capacitor have a capacitance of 0.1 microfarad to give the desirable starting and lamp balance characteristics.

There have been instances where high peak currents have occurred in certain ballasts due, it is believed, to the creation of harmonics of the fundamental frequency of the current wave shape resulting from the combination of the shunting capacitor and the secondary winding. The solution to the problem in the past has been to provide additional inductance in the circuit through the use of auxiliary chokes for suppressing the spikes. Such circuits are disclosed, for example, in Hume Pat. No. 3,225,255 and Feinberg et al Pat. No. 3,195,012. Added components increase the cost of the ballast, not only because of the additional copper and steel but also due to the added labor of connecting them into the circuit. Additionally, they increase the size of the ballast.

The invention solves the problems mentioned by providing means for suppressing the current peaks in the second-to-ignite lamp through the incorporation of inductance in the shunting branch which is parallel with the second-to-ignite lamp that requires no substantial changes in the manufacture of the ballast as though it were a conventional ballast. This is done by utilizing a few turns of the secondary winding to serve as an inductance in series with the capacitor shunting the second-to-ignite lamp while these turns are still being used along with the remainder of the secondary winding as the total operating secondary winding for the ballast.

SUMMARY OF THE INVENTION

A ballast for igniting and operating a pair of low power rapid start gaseous discharge lamps from a source of a.c. power and including a transformer having a primary winding and a secondary winding loosely coupled one to the other, there being filament windings coupled to the primary winding for serving the filaments of the lamps. There is a capacitor shunting the second-to-ignite lamp and a capacitor in series with both lamps and the secondary winding to provide a leading current when the lamps are operating. The application of power to the primary winding initially provides an igniting voltage across the first-to-ignite lamp which is sufficient to ignite that lamp alone but insufficient to ignite both lamps in tandem. After this first-to-ignite lamp ignites and current flows through the capacitor shunting the second-to-ignite lamp a voltage is produced across the shunting capacitor which is high enough to ignite the second-to-ignite lamp by itself after which current substantially by-passes the shunt capacitor. The operating circuit therefore includes the lamps, the series capacitor and the secondary winding. If all or any part of the primary winding is connected in autotransformer relationship with the secondary winding then the series operating circuit will include this as well.

Current spikes generated because of the presence of the shunting capacitor appearing in the second-to-ignite lamp during operation are suppressed by connecting a portion of the secondary winding in series with the shunting capacitor to add inductance to the shunting branch. This does not reduce the voltage produced by the secondary winding available for use during operation. The slight loss of voltage for use during ignition of the first-to-ignite lamp is found to have no deleterious effect upon ignition of said lamp.

DESCRIPTION OF THE PREFERRED EMBODIMENTS

The invention is concerned with a ballast for use in igniting and operating certain kinds of fluorescent lamps from relatively low voltage power supplies and in the circuit itself. Primarily the ballast and its circuit are intended to provide everything that is required of a normal apparatus for rapid start lamps ignited in sequence and operated in series and at the same time to provide means for suppressing current spikes which are deleterious to the second-to-ignite lamp of the pair.

At the outset it should be pointed out that the ballast and the ballast circuit constitute different entities. A ballast is an article of manufacture which is sold by a specialized type of manufacturer to be incorporated into a ballast circuit. The ballast for fluorescent lamps will normally comprise a canister in which are disposed the transformer, capacitors, resistors and perhaps safety devices such as thermally operated switches all encapsulated in a potting compound. The canister has mounting brackets to enable it to be installed in a fixture or the like and has wires protruding with different colors coded according to standards which may have been promulgated by standards associations, underwriters' groups and/or local ordinances. The ballast canister has a permanently affixed label which provides the ratings of the ballast, describes the circuits into which it is to be connected and the manner in which the several wires are to be connected. Above all the label describes the kind of lamps which are to be used with the ballast.

The ballast circuit, on the other hand, will be the total apparatus which includes the ballast, the lamps, the source of power and perhaps sockets for the lamps which may have automatic disconnect means.

In the claims it will be understood that the ballast will be claimed in one aspect and the ballast circuit in another.

An understanding of the basic rapid start sequence start series operate circuit is required for a comprehension of the invention. Those skilled in the art will be well aware of the construction and operation of the circuit, but a brief explanation in connection with FIGS. 1*a* and 10 will be useful.

Figure 1A:
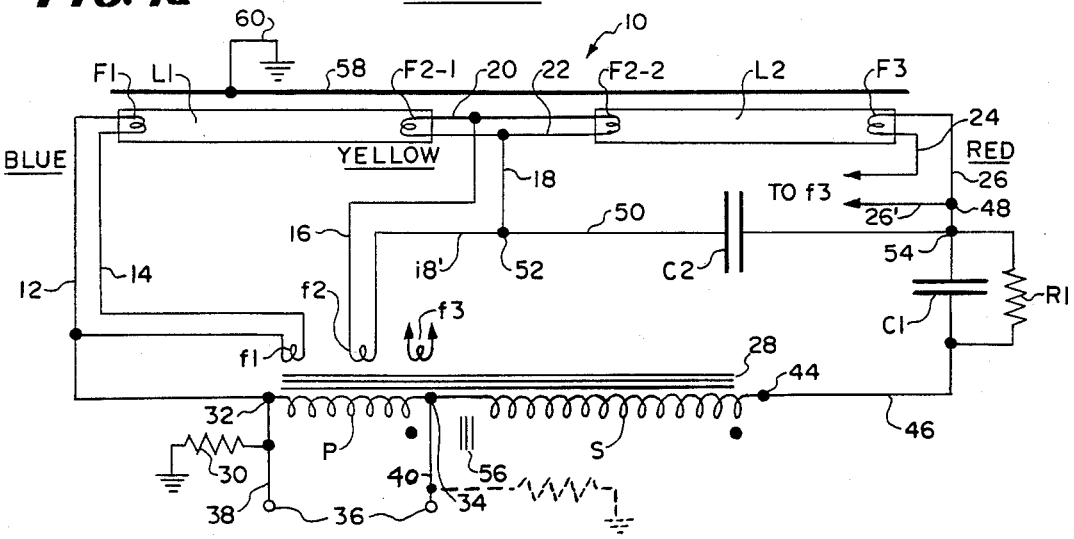
FIG. 1a PRIOR ART
FIGS. 1*a* and 1*b* are circuit diagrams of rapid start ballasting circuits for conventional types of rapid start lamps, these being prior art circuits.

In FIG. 1*a* the ballast circuit is designated 10 and is a prior art structure whose construction and operation are well-known and of the most common type. The circuit includes two rapid start fluorescent lamps L1 and L2 which may be 48 inch T-12 40 watt lamps that are 1½ inches in diameter. These lamps contain the usual mixture of gases and would be coated on their interior surfaces with phosphors which fluoresce when bombarded by the ultraviolet radiant energy generated on the interior of the lamp when the contained gases ionize. Rapid start lamps are characterized by the presence of lamp filaments shown here as F1, F2-1, F2-2 and F3 in their ends. The filament F1 is energized by the filament winding f1 connected thereto by the wires 12 and 14; the filaments F2-1 and F2-2 are both energized in parallel by the filament winding f2 connected thereto by the wires 16 and 18' which extend respectively to the patching wires 20 and 22 extending between the lamps L1 and L2; and the filament F3 is energized by the filament winding f3 connected thereto by the wires 24 and 26'. The wires 18' and 26' include leads 18 and 26 respectively.

There is a transformer 28 whose iron core is represented by the parallel lines shown. The transformer has a primary winding P whose terminals 32 and 34 extend to a pair of line terminals 36 by way of the leads 38 and 40, respectively. These leads will be two which emerge from the canister which has been described. The leads 12, 14, 16, 18, 24 and 26 to be extended to the lamps will also emerge from the canister as well. Conventional color coding is provided for these leads. If the lead 38 is grounded either directly or through resistor 30 as shown in solid lines it will be white while the "hot" lead 40 will be black. There are circumstances when the lead 40 will be grounded as shown by the dotted lines in which case the colors will be reversed.

The lamp leads emerging from the ballast canister are coded conventionally with the leads 12 and 14 being blue because they extend to the first-to-ignite lamp L1 and the leads 24 and 26 being red because they extend to the second-to-ignite lamp L2. The common leads 16 and 18 which extend to the inwardly shown filaments F2-1 and F2-2 are yellow. In the vernacular of ballast engineers the first-to-ignite lamp is often referred to as the "blue" lamp while the second-to-ignite lamp is referred to as the "red" lamp.

The transformer 28 has a secondary winding S which has a turns ratio relative to the primary winding P in order to generate a sufficient open circuit voltage to ignite one lamp and operate two in cooperation with the primary voltage. The terminals 34 and 44 of the secondary winding S are internal of the canister. The terminal 44 is connected by way of the lead 46 to the filament F3 and at the terminal 48 which is internal of the canister the lead 46 connects with the red filament lead 26 that emerge from the canister. There is a capacitor C1 in series with the secondary winding S in the lead 46 shunted by the bleed resistor R1. The lamp L2 is shunted by a capacitor C2 in the lead 50 which extends between the terminal 52 connecting to the emerging yellow lead 18 and the terminal 54 both of these terminals being interior of the canister. The capacitor C2 is in this circuit 10 not shunted by a bleed resistor. It will be assumed that the capacitance of the capacitor C2 is 0.06 microfarad or less.

The primary winding P and the secondary winding S are in loosely coupled relationship with one another as indicated by the symbolic lines 56. This can be achieved by shunts between the windings or by physical spacing between the windings without shunts or by constructing the windings to be relatively elongate or a combination of any or all of these. Practically, coil margins usually result in as much as a quarter of an inch spacing between side by side mounted coils.

In the circuit 10 the primary winding P and the secondary winding S are connected in autotransformer relationship with the instantaneous polarity of the windings arranged additive as shown by the large dots. As such they are connected together at the terminal 34 and the left hand terminal 32 of the primary winding P is connected directly to the lead 12 which extends to the filament F1 while also extending to the filament winding f1. Like the most conventional of the rapid start ballast circuits it is assumed that the voltage at the lamp terminals is low enough so that there is no need for isolating the primary winding P from the secondary winding S. This, then is the simplest and most economical of the rapid start ballast circuits for use, for example, with two 40 watt rapid start fluorescent lamps connected in series-sequence circuit. The primary winding P contributes voltage to that generated by the secondary winding S to ignite the first-to-ignite lamp L1 and it also contributes voltage to the secondary winding S to operate both of the lamps in series.

The metal fixture in which the lamps will be installed is designated symbolically by the heavy line 58 and it is grounded as indicated at 60. With the arrangement as shown a voltage developed across an isolating resistor 30 may be added to the voltages provided in series by the secondary winding S and the primary winding as an added starting voltage for the lamps. This is coupled capacitively to the lamps. Ballasts for 40 watt rapid start lamps at present do not use such an isolating resistor.

When the primary winding P is energized from the line at the terminals 36 a high open circuit voltage will appear across the secondary winding S and this will be added to the voltage across the primary winding P to appear at terminals 32 and 44. In effect this sum voltage will be applied through the capacitors C1 and C2 directly across the filaments F1 and F2-1 of the lamp L1. This is because neither of the capacitors C1 and C2 is carrying current at this time. The ballast is constructed so that the open circuit voltage developed under these circumstances will be sufficient to ignite the lamp L1.

At the same time that the winding P is energized, the filament windings f1, f2 and f3 all of which are closely coupled to the primary winding P are also energized. The filaments of the lamps are thus immediately heated up and clouds of electrons are emitted which tend to lower the igniting and operating voltages of these lamps.

For a typical rapid start lamp of the 40 watt type operated under rated conditions the open circuit voltage developed across the lamp L1 immediately after energizing the primary winding P will be 280 volts RMS and with a voltage to ground added by way of the fixture 58 of about 260 volts peak. The lamp L1 will ignite and current will flow through the lamp L1 and the by-pass circuit represented by the capacitor C2. It will be recalled that the lamp L2 is not ignited yet. Current flowing in the capacitor C2 produces a voltage across the capacitor C2 which will reach 250 volts RMS, exceeding the igniting voltage of Lamp L2. The lamp L2 now ignites and current flows through this lamp in preference to the shunting capacitor C2. If an isolating resistor such as 30 is used in this circuit it would be typically of the order of megaohms.

The operating circuit of the ballast circuit 10 now becomes the two lamps in series with the capacitor C1, the primary winding P and the secondary winding S. The operating voltage of each of the lamps for the 40 watt rapid start type is about 100 volts RMS. The current through the lamps is 430 ma. RMS. As stated the typical capacitance of the capacitor for this kind of circuit is 0.05 microfarad rated at about 100 volts a.c. The series capacitor in these circuits is typically 3.8 microfarads.

Figure 1B:
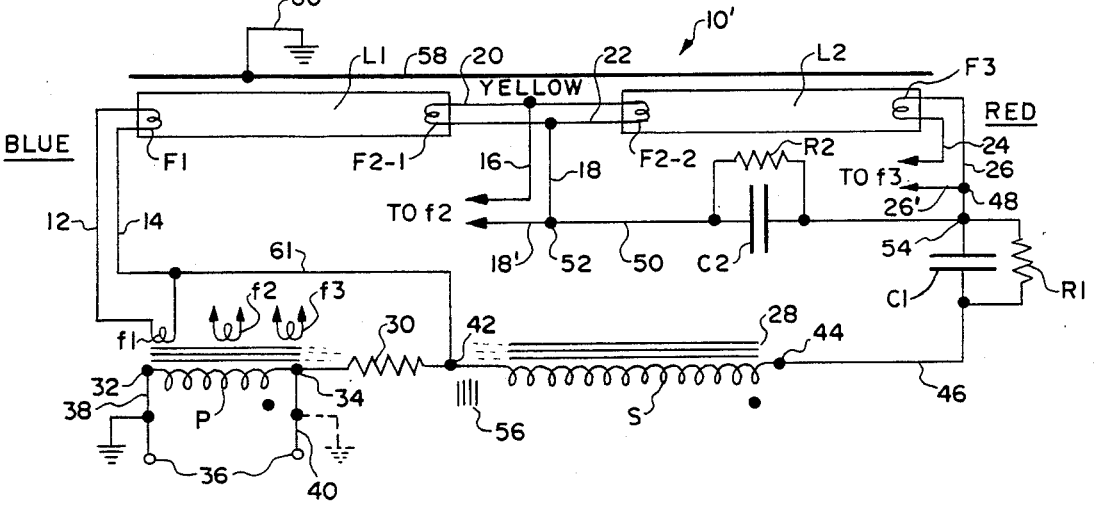
FIG. 1b PRIOR ART

The circuit 10' of FIG. 1*b* is also a prior art circuit but not as common and well-known as the circuit of FIG. 1*a*. The purpose for illustrating this circuit is to demonstrate what modifications would normally be made by one skilled in the art from the more conventional circuit in order to accommodate the requirements of rapid start lamps which require higher starting and operating voltages as well as an increased capacitance of the shunting capacitor C2.

In the circuit 10' the same reference characters are used to designate the same or similar components.

The principal differences between the circuits of FIGS. 1*a* and 1*b* are that the primary winding P and the secondary winding S are connected in straight transformer relationship with an isolating resistor 30 between them; the terminal 42 of the secondary winding S is connected directly to the filament F1 by way of the lead 61 and the lead 14; and there is a bleed resistor R2 across the shunting capacitor C2. The lead 40 may in certain instances be grounded as indicated by the broken line connection. The core of the transformer 28 is continuous, the broken lines being used in the diagram to indicate this. The location of the isolating resistor 30 is for clarity in understanding the diagram but should be understood not to interrupt the physical or electromagnetic continuity of the transformer core.

In FIG. 1*b* the circuit operates somewhat differently from that of FIG. 1*a* but only in the respect that the secondary winding S no longer receives any assistance from the voltage of the line to start the first-to-ignite lamp L1 or to operate both lamps in series; hence its turn ratio relative to the primary winding P must be such that all of the voltage for starting and operating must be developed in the secondary winding S by itself.

This circuit 10' is about as close to the highly effective and economical circuit 10 of FIG. 1*a* as one could come in providing the necessary voltages, currents, etc. for igniting and operating a pair of rapid start lamps of 32 watts rating which have been described. The circuit is not suitable, however, because of the presence of the current spikes which have been described. In rapid start circuits heretofore there have been current spikes produced by the discharge of the shunting capacitor C2 in the second-to-ignite lamp L2 but these have been insignificant with the types of lamps that have been in use until the present. The increase of the capacitance of the shunting capacitor C2 under normal conditions of usage with known rapid start lamps would not be serious in the circuit of FIG. 1*b* but could not be tolerated in the case of the 32 watt lamps mentioned because of the excessive current peak occurring each half cycle.

Figure 2:
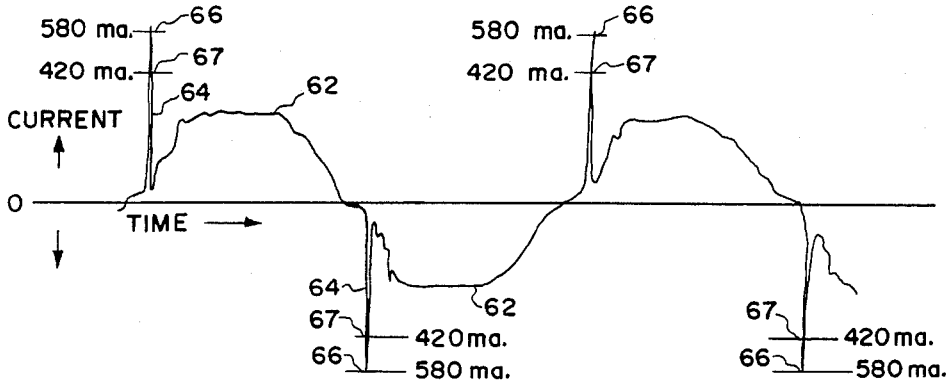
FIG. 2 is a diagram of the current wave shape of the current appearing during operation in the second-to-ignite lamp of a circuit like that of FIG. 1*b* but when used with a certain type of low wattage lamp which results in a deleterious current spike.

In FIG. 2 there is illustrated a graph of the wave shape of the current in the lamp L2 in a circuit which is similar to that of FIG. 1*b* but utilizing the 32 watt T-8 lamps mentioned above and a shunting capacitor of 0.1 microfarad. As seen the configuration of the current wave at 62 is for the most part excellent, being practically a rectangular wave representing substantial illumination during the respective half cycles. At the beginning of each half cycle, it will be noted, there is a high current peak 64, this peak occurring on both positive and negative half cycles. For the circuit which is described in FIG. 1*a* the maximum excursion of the peak at 66 would be about 580 ma.

The crest factor of the wave with the 580 ma. peak is approximately 2.3 which exceeds the crest factor 1.7 which is the maximum specificed by the lamp manufacturer. This crest factor could not be tolerated by the lamp L2 for any extended period of time.

Figure 3:
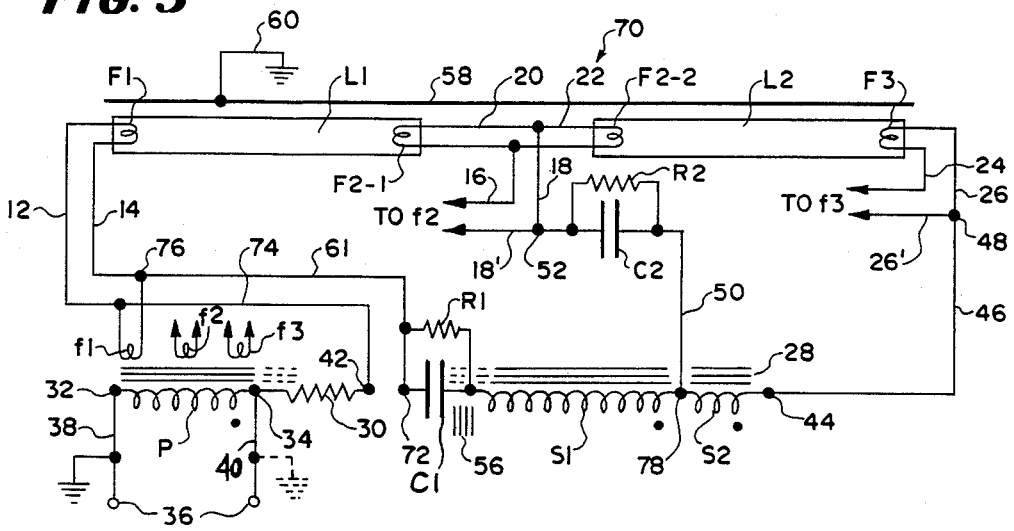
FIG. 3 is a circuit diagram of one embodiment of the ballast circuit of the invention which suppresses the current spikes shown in the wave shape diagram of FIG. 2.

In FIG. 3 there is illustrated a ballast circuit 70 which reduces the peak substantially. In a practical circuit constructed according to the invention and utilizing the 0.1 microfarad capacitor in the position of C2 the T-8 lamps mentioned were only subject to a peak current of about 420 ma. as indicated at 67 in FIG. 2, a reduction of 20% without any substantial change in the remainder of the wave shape. The crest factor in this case was 1.7, which was established by the lamp manufacturer as permissible.

In FIG. 3 as well as the other circuit diagrams hereinafter the same reference characters will be used wherever practical to identify the same or similar parts for convenience.

In this circuit, the operating capacitor C1 is connected between the secondary winding S1, S2 and the terminal 72 which extends by way of the lead 61 to the terminal 76 and the lead 14. The terminal 42 extends by way of the lead 74 to the lead 12. The capacitor C1 could as well be elsewhere in the series circuit since it performs its function only during operation of the two lamps. The lead 74 or 61 could be eliminated and the terminals 42 and 72 connected together. The actual connections as shown are in the practical example and are brought about by some structural situations making the circuit illustrated easier or more practical to build.

The important feature of the invention is that the secondary winding is divided into two parts, that is, a main part S1 and a second part S2. The lead 50 in the circuit 10 of FIG. 1 is seen connected directly in parallel with the lamp L2. In the ballast circuit 70 of FIG. 3 the lead 50 extends to a tap 78 between the main secondary winding part S1 and the auxiliary portion S2 so that in considering the shunting branch around the lamp L2 the auxiliary portion S2 is in series with the capacitor C2.

In considering the igniting circuit for the lamp L1 the auxiliary secondary part S2 does not participate voltage-wise because the shunting branch is arranged to come into effect only during operation so far as the auxiliary secondary winding S2 is concerned. One would assume that there should be compensating turns added to the main part S1 of the secondary winding to make up for the loss of open circuit voltage to ignite the first-to-ignite lamp L1 so that a circuit like the ballast circuit 10′ built for two lamps such as the 32 watt rapid start lamps described would have a total of more turns in its secondary winding than considered necessary without the auxiliary secondary winding part S2. It has been found that the number of turns of S2 needed for lowering the crest factor of the current wave to 1.7 does not lower the open circuit voltage of the secondary main part S1 to have any discernible effect on the ignition of the lamp L1 even though the voltage of the auxiliary part S2 is not included in the igniting circuit. This means that the design of a ballast like that of FIG. 1*b* for two 32 watt rapid start lamps is similar to the design of the ballast 70 of FIG. 3, especially in the respect that the transformer 28 and its windings complete to the number of turns and kind of wire are identical in both cases. The only difference is that in the circuit 70 of FIG. 3 there is a tap at 78.

The invention includes any ballast circuit in which the number of turns of the secondary winding and the division of these turns between the part S1 and the part S2 will provide proper ignition voltage for the first-to-ignite lamp L1, the proper voltage for the operation of the two lamps in series after they have been ignited and sufficient inductance in S2 to suppress the current spike produced in lamp 2 to any acceptable value. At the present time and with the only T-8 lamp commercially available it has been found not required to add turns to the secondary winding for increasing the open circuit voltage of the main part S1 over the number of turns which would be required for a ballast without the auxiliary part S2. If other lamps of this type reach the market place the circuit of the invention could be varied to meet any new ignition and/or operating voltage requirements without departing from the teachings thereof.

Tracing the circuit after ignition of the lamp L2 it can be seen that the shunting circuit includes the auxiliary part S2 and this gives sufficient inductance to the shunting circuit to decrease the current peak 66 of the current wave shape of FIG. 2 to a much lower value than would occur if the winding S2 were not in the shunting branch. As stated, in the practical circuit, this lower value, indicated at 67 was 420 ma. Adjustment of parameters can provide lower or higher peaks depending upon the requirements of the particular lamp.

Figure 4:
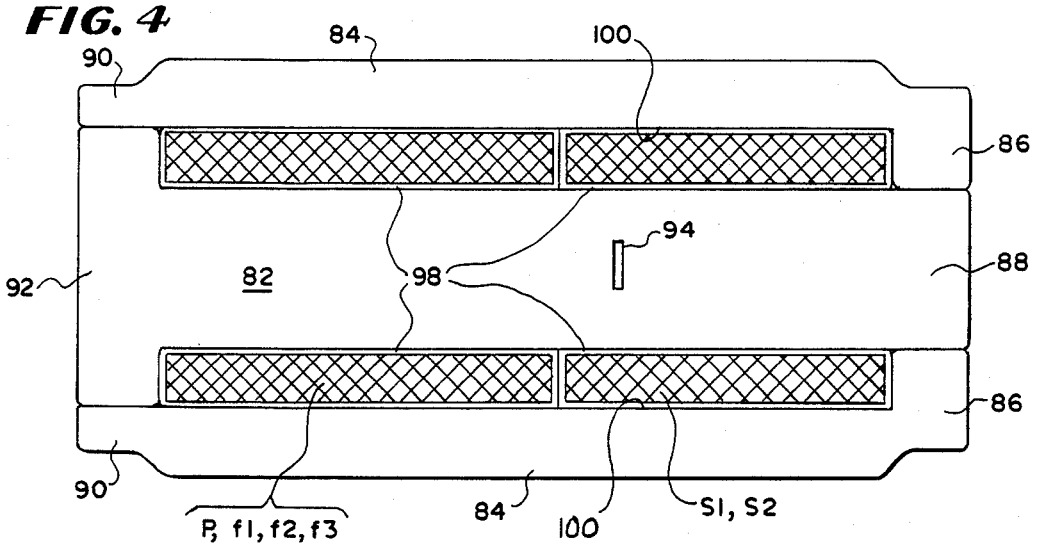
FIG. 4 is a sectional view through the transformer of the ballast of FIG. 3 this being only one example of the type of transformer which is suitable for the purpose.

The practical example embodying the ballast circuit of FIG. 3 utilized as the transformer 28 a shell type transformer such as illustrated in section in FIG. 4. There is a T-shaped winding leg 82 and outer framing members 84 of L-shaped configuration. The angled ends 86 of the framing members 84 abut the plain end 88 of the T-shaped central leg on the right while the straight ends 90 of the framing members 84 abut the crosshead 92 of the central winding leg 82. A transverse slot 94 is provided in the central winding leg 82 under the secondary winding.

The core is formed by punching substantially scrapless laminations from electrical steel with the grain extending preferably along the length of the laminations, stacking them and clamping them together by suitable clamps or welds, neither of which are shown.

The windings are made in suitable winding machines by well-known methods on paper or the like insulating tubes as indicated at 98, slipped on to the central winding leg 82 and then assembled with the outer framing members 84.

A single long window 100 is formed in the core of FIG. 4 from the particular laminations shown on opposite sides of the central winding leg. In this window are disposed the windings which have been described in FIG. 3. In the left hand part of the windows 100 are disposed the primary winding P and the filament winding f1, f2 and f3. In the right hand parts of the windows 100 are disposed the secondary winding S1 and the auxiliary secondary winding S2. In the practical example the main portion of the secondary winding S1 had 2219 turns of wire while the auxiliary secondary winding S2 had 192 turns of wire. The auxiliary winding thus has less than ten percent of the turns of wire in the main secondary winding S1 and yet it is sufficient to provide the needed inductance to suppress the current spikes during operation of the ballast circuit.

One of the important advantages of this form of inductance for the shunting branch besides its ability to suppress the current spikes in the lamp L2 during operation while cooperating with the main secondary winding S2 to furnish operating voltage is its extreme economy of construction. In winding coils for transformers used in ballasts the winding process proceeds on a mandrel carrying a long paper tube to which a plurality of wires are connected mechanically so that a plurality of coils are wound to form a "stick". Any time it is desired to have a tap at any point during the winding, after the desired number of turns has been wound on each of the coils, a loop is pulled off the mandrel at the desired point, extended to the end of the coil and taped in position after which the coil is completed. The stick is then sawed through to form the individual coils and the end terminals "picked out" of the ends by assemblers who also pick out the loop. The loop can become a single tap by baring the wire of its enamel if it is enamelled and twisting it together to form a terminal. This is the manner in which the terminal 78 is formed.

The process described is well-known and the time and effort required to form and pull out the tap-forming loop is miniscule. The connecting of the lead 50 to the tap 78 during assembly of the circuit costs nothing because in a conventionally constructed ballast the lead 50 (FIG. 1*b*) would have to be connected to the terminal 44 anyway.

Adverting once again to FIG. 4, the overall length of the core in the practical example was about 4 9/16 inches. FIG. 4 has been drawn proportionally so that the remainder of the dimensions are easily scaled from that. The elongate nature of the structure provides considerable leakage between the primary winding P and the secondary windings S1 and S2 so that ballasting is provided when the lamps are operated. If desired, shunts with suitable gaps could be positioned between the windings as disclosed in the drawings of Pat. Nos. 2,820,180 and 2,900,577.

The details of the practical example mentioned heretofore are as follows (for a 120 volts, 60 hertz, a.c. line):

Lamps—two Sylvania Octron T-8 32 watt fluorescent.
Rated starting voltage—300 volts at 90% rated input voltage.
Rated operating voltage—135 volts, each lamp.
Rated operating current—265 ma.
Shunt capacitor C2—0.1 mfd.
Capacitor rating 135 volts, a.c.
Operating capacitor C1—1.8 mfd.
Capacitor rating 360 volts a.c.
Laminations—T-shaped central leg 82:
4.557" long; 0.814" wide; 1.444" at the crossbar 92;
Outer framing members 84: same length; width 0.350";
distance from winding leg (width of windows) 0.315"; length of windows 3.787";
Stack height—0.700";
Silicon steel laminations 26 gauge, electrical grade;
Slot—0.250"×0.050" at 1.80" from the right end.
Primary winding P—845 turns of #23 coated wire A.W.G., length 2.05 inches.
Secondary winding S1—2219 turns of #28½ A.W.G. coated wire; S2—192 turns of same wire.
Total length of secondary winding (S1+S2) 1.7 inches.
Filament windings—f1 27 turns; f2 29 turns; f3 27 turns, all 27 A.W.G. coated wire.
Resistor 30—470,000 ohms ½ watt.
Resistors R1 and R2—5.6 megaohms ½ watt.
Voltages:
S1 open circuit—293
S1 operating—363
S2 open circuit—24
S2 operating—30
C1 operating—354
Currents:
Line during operation 617 m.a.
Lamps 235 m.a.
All current and voltage values are R.M.S.

Figure 5:
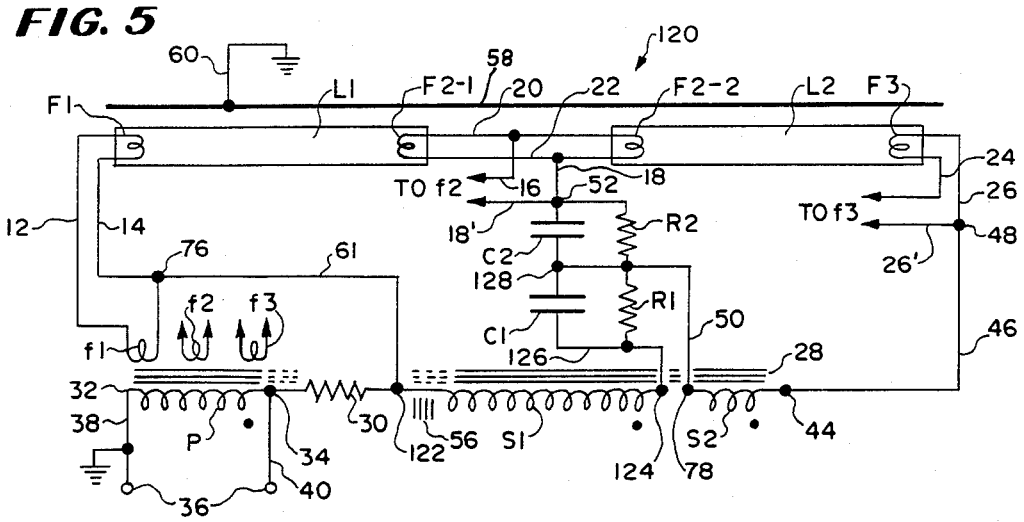
FIG. 5 is a circuit drawing of another embodiment of the ballast circuit of the invention in which there is a different arrangement of the location of the capacitors of the circuit of FIG. 3.
Figure 6:
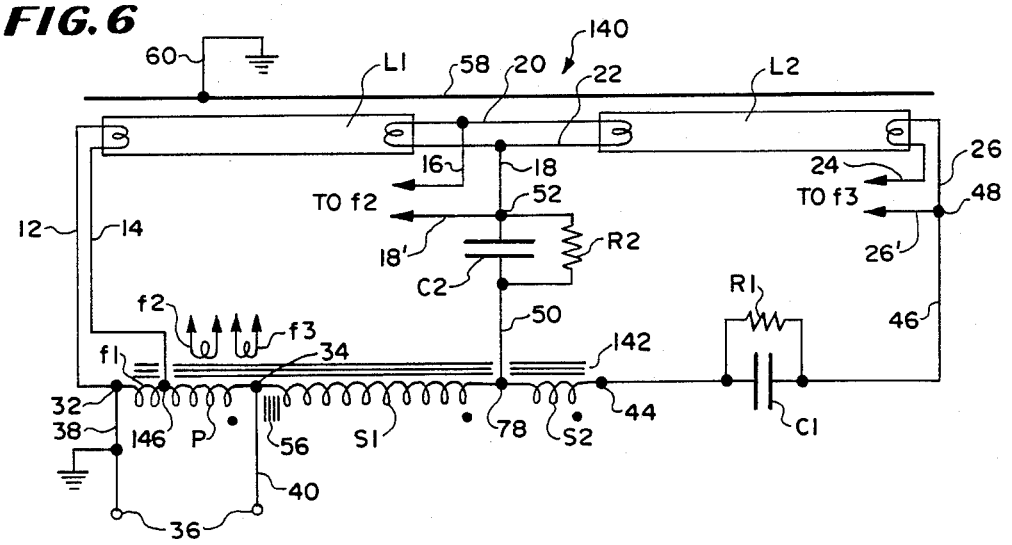
FIG. 6 is a circuit drawing of still another embodiment of the ballast circuit of the invention the circuit in this case providing for a voltage from the primary winding to be added to that of the secondary winding by way of an autotransformer arrangement.
Figure 7:
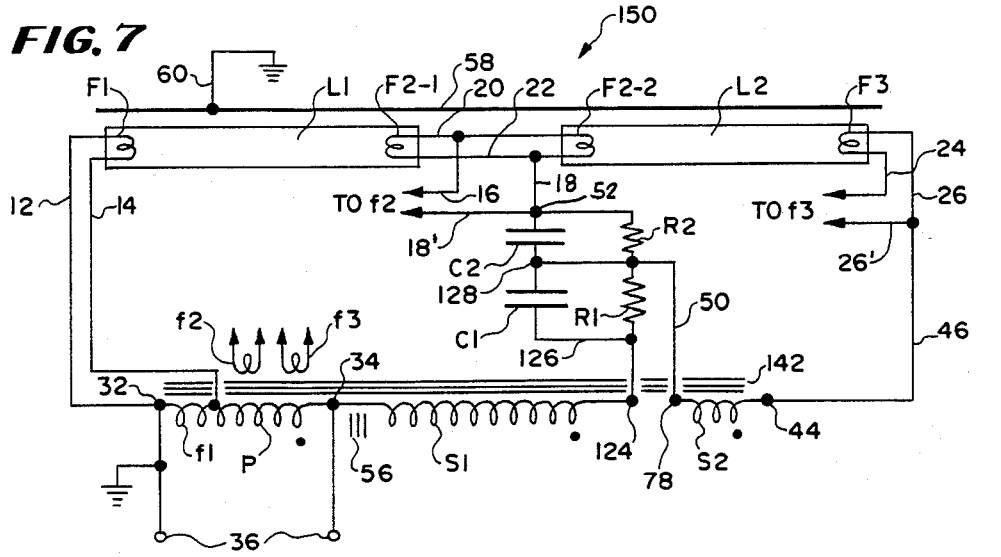
FIG. 7 is a circuit drawing of still another embodiment of the ballast circuit of the invention similar to that of FIG. 6 but in which the capacitor arrangement is similar to that of FIG. 5.

In FIGS. 5, 6 and 7 there are illustrated different ballast circuits which are constructed in accordance with the invention and operate in the manner explained to suppress the current spikes in the second-to-ignite lamp L2 in each case.

In FIG. 5 there is illustrated a ballast circuit 120 which differs from the circuit 70 in that the isolating resistor 30 is connected directly to the secondary winding S1 at the terminal 122 which is a combination of the terminals 42 and 72 of FIG. 3. In this case the lead 74 has been eliminated and the operating condenser C1 has been moved to the position between the secondary windings S1 and S2. Thus, the right hand end of the secondary winding S1 has the terminal 124 which connects by the lead 126 to the terminal 128 through the capacitor C1 and thence by way of the lead 50 back to the terminal 78. The capacitor C1 is in series with the secondary windings S1 and S2 for operating the lamps but has a common terminal 128 with the capacitor C2. It is thus practical to use a type of capacitor which has two capacitive elements in the same housing and only three terminals. The internal connections of this ballast circuit 120 are simpler because of this arrangement.

In the ballast circuit 140 of FIG. 6 the circuitry is changed primarily in that there is an autotransformer arrangement for the transformer 142. A different reference numeral is given to the transformer in this case because the requirements and connections are somewhat different from those of the transformer 24 although the construction may be quite similar. Here there is no isolating resistor because the voltage across the primary winding P is intended to be added to the voltage of the secondary winding S1 in starting the first-to-ignite lamp L1. Furthermore, the voltage across the primary winding P is intended to be added to the voltages of both the secondary windings S1 and S2 in operating the lamps.

Again in the transformer 142 the tap 78 can be formed by joining the two ends pulled out of the coil as a loop when the coil is formed because there is only one lead needed at that point. In the transformer 28 of FIG. 5 when the same loop is pulled out of the coil as it is formed, the loop is cut in order to provide the two terminals 78 and 124 with their respective leads 50 and 126.

In each of the ballasting circuits 10, 10', 70, 120 and 140 as well as in the circuit to be described in connection with FIG. 7 the instantaneous polarity of the windings illustrated is indicated by a dot at the end of each winding. In the case of transformers where the primary winding is isolated from the secondary winding or windings instantaneous polarity is not consequential to the ignition and operation of the lamps. In the case of autotransformer arrangements, however, it is essential that the windings be additive so that the primary voltage can be used for starting and operating the lamps in addition to the voltages generated in the secondary windings. In the ballast circuit 140 of FIG. 6 it should be obvious for purposes of utilizing the primary winding P in an autotransformer additive arrangement that the polarities of all of the windings should be the same at any instant; hence the dots representing instantaneous polarity are all on the same ends of the windings.

In the ballast circuit 140 of FIG. 6 instead of a separate filament winding for serving the filament F1 a portion of the primary winding P is tapped at 146 to be used as the filament winding f1 in a manner which is well-known in the art.

The ballast circuit 140 has one disadvantage in that the operating capacitor C1 in the lead 46 is in series with the starting capacitor C2 for the shunting branch during the ignition of Lamp L1. Adjustments may have to be made to the parameters of the circuit in order to ensure proper starting of the lamps and that the desired peak current suppression will in fact be accomplished. In the event that adjustments present a problem the capacitor C1 can be inserted in the connection at terminal 34 between the primary winding P and the secondary winding S1 in the same manner that this is done in the ballast circuit 70 of FIG. 3. For the purposes of providing proper capacitive reactance during operation the capacitor C1 can be anywhere in series with the lamps and the active windings.

It will be noted that although in FIG. 6 the capacitor C1 of the ballast circuit 140 is in the shunting circuit around the lamp L2 it is not in the igniting circuit for the lamp L1. The open circuit voltage induced in the secondary winding main part S1 when the primary winding P is energized ignites the lamp L1 by combining with the line voltage appearing across the primary winding P because it is not affected by the presence of the shunting capacitor C2 which at the time carries no current. When the lamp L1 ignites and current flows through the capacitor C2 there is no current flowing through the capacitor C1 hence the voltage produced in the capacitor C2 is all available for igniting the lamp L2 but for minor modification due to the presence of the auxiliary secondary winding S2 in the shunting circuit. After ignition of the second-to-ignite lamp L2 the capacitor C2 is by-passed effectively so far as operation of the lamps in series is concerned and only the capacitor C1 is in the series circuit. The capacitor C2 makes its presence felt, however, by producing the undesirable spike such as illustrated in FIG. 2 at 64 which in turn is suppressed by reason of the auxiliary secondary winding S2.

FIG. 7 illustrates a ballast circuit 150 which differs from the circuit 140 in the same manner that the circuit 120 differs from the circuit 70. The transformer 124 is connected in additive autotransformer relation with its secondary so that the voltage of the primary winding P is added to the voltage of the secondary winding S1 in starting the first-to-ignite lamp L1 and is additive to the both secondary windings S1 and S2 in operating the lamps in series. The capacitors have a common terminal and can be placed in a housing with only three external terminals. In this case the capacitor C1 does not participate in the starting the second-to-ignite lamp L because it is not in the shunting branch.

The invention is capable of variation in details without departing from the spirit or scope of the invention as defined in the appended claims. For example, where a primary winding P is illustrated and described as participating fully in an autotransformer arrangement in FIGS. 6 and 7 it could just as well be connected in such a manner that only a portion of the primary is connected in autotransformer relationship with the secondary windings S1 and S2. This will enable fine adjustments of the power factor of the ballast circuit in some cases.

The practical example given in this specification was designed for operation from a 120 volt a.c. line but this should not infer that the invention is limited to such line voltage. Even the identical lamps and much of the structure which is described for the practical example could be used with 240 volt and 277 volt lines by simply increasing the number of turns in the primary winding P while decreasing the gauge of wire used. Ballast designers will be capable of utilizing the teachings of the invention as disclosed herein for arriving at the proper parameters for different requirements of line voltage and variations in the specifications of the lamps of the type which cause the high current spikes.

What it is desired to secure by Letters Patent of the United States is:

1. Ballast apparatus for starting and operating a pair of low pressure gaseous discharge lamps of the rapid start type having end filaments from a source of a.c. power and in which the lamps are connected to be ignited in sequence and operated in series, comprising:

A. an iron core transformer having a primary winding and means for extending the terminals of said primary winding to said source, a secondary winding having a main winding part and an auxiliary winding part closely coupled together, the secondary winding including main and auxiliary winding parts being in transformer relationship with said primary winding whereby to generate an induced voltage when the primary is energized for igniting said lamps, the primary winding being loosely coupled to said secondary winding main and auxiliary winding parts whereby to provide a leakage reactance in the secondary winding for ballasting the lamps when said lamps are both operating, B. means for connecting the lamps in series with one another and in series with at least the secondary winding, C. a first capacitor in series with the secondary winding and adapted to be in series with said lamps during operation whereby to provide a leading current when the lamps are both operating and D. a second capacitor connected with said lamp connecting means and in series with said auxiliary winding part of said secondary winding in such a manner that when the lamps are connected in circuit with said at least secondary winding the second capacitor and auxiliary winding part form a shunting branch around the second lamp, the apparatus being operative when the primary winding is initially energized to apply the voltage of said at least secondary winding excluding the auxiliary winding part to the first lamp to ignite the same and thereafter the flow of current in said shunting branch generates a voltage across said second capacitor sufficient to ignite the second lamp notwithstanding the presence of the auxiliary winding part in series therewith and thereafter both lamps operate in series with the at least secondary winding including the auxiliary winding part and the first capacitor, the second capacitor being effectively by-passed.

2. The ballast apparatus as claimed in claim 1 in which the primary and secondary windings are connected in straight transformer relationship such that the primary winding voltage does not directly participate in the voltage igniting or operating the lamps.

3. The ballast as claimed in claim 2 in which there is an isolating resistor between said secondary winding and said primary winding, one of the terminals of said primary winding being grounded whereby to generate a starting aid voltage across said resistor available to aid in starting said lamps.

4. The ballast as claimed in claim 1 in which at least a portion of the primary and secondary windings are connected in autotransformer relationship and the ignition voltage for the first lamp as well as the operating voltage for both lamps include voltage produced in the at least a portion of the primary winding.

5. The ballast as claimed in claim 2 or claim 4 in which the capacitors are connected together with a common terminal.

6. The ballast apparatus as claimed in claim 1 in which there are three filament windings in close coupled relationship with the primary winding, means for extending connections from one filament winding to the first end filament of the first lamp, means for extending connections from the second filament winding to the second end filament of the first lamp and the first end filament of the second lamp and means for extending connections from the third filament winding to the second end filament of the second lamp, the said shunting branch adapted to be connected from the first end filament of the second lamp to the second end filament of the second lamp.

7. The ballast circuit as claimed in claim 1 in which the capacitors are both in series with said at least the secondary winding and by-passing the second lamp during ignition of the first lamp.

8. The ballast circuit as claimed in claim 1 in which only the second capacitor is in series with said at least the secondary winding and by-passing the second lamp during ignition of the first lamp but said first capacitor is included in the said shunting branch during ignition of the second lamp.

9. Ballast apparatus for starting and operating a pair of low pressure gaseous discharge lamps of the rapid start type having end filaments from a source of a.c. power and in which the lamps are connected to be ignited in sequence and operated in series, comprising:

A. an iron core transformer having a primary winding and means for extending the terminals of said primary winding to said source, a secondary winding having a main part and an auxiliary part, the secondary winding being in straight transformer relation with the primary winding and isolated therefrom, the turns ratio and the voltage of the source being such that the voltage induced in the main part of the secondary winding is sufficient to ignite one lamp and the voltage induced in both parts of the secondary winding when connected to said lamps in series being sufficient to sustain operation of said lamps in series, the primary and secondary windings being loosely coupled with one another on said transformer core to provide a leakage reactance in the secondary winding for ballasting the lamps when both are operating, B. filament windings closely coupled with said primary winding and means for extending connections from said filament windings to the end filaments of said lamps, C. a first capacitor and means for connecting the lamps in series with one another and in series with said secondary winding and said first capacitor in an operating loop through the said filaments of the lamps whereby to provide a leading current in the loop during operation of said lamps, D. a second capacitor in series with the said auxiliary part and forming with said auxiliary part and said connection extending means a shunting branch across the filaments of the second lamp by-passing said second lamp, the apparatus being operative when the primary winding is initially energized to apply the voltage of the main part of the secondary winding excluding the voltage of the auxiliary part to the first lamp through at least said second capacitor to ignite said first lamp, the flow of current in the said shunting branch acting to generate a voltage across said second capacitor sufficient to ignite the second lamp notwithstanding the presence of the auxiliary part of said secondary winding in series with said second capacitor, the both lamps thereafter operating in series with the secondary winding including the auxiliary part and the first capacitor, the second capacitor being effectively by-passed.

10. The ballast apparatus as claimed in claim 9 in which there is an isolating resistor connected between one terminal of said primary winding and a terminal of said secondary winding and a starting aid voltage is generated across the said resistor.

11. The ballast apparatus as claimed in claim 9 in which both capacitors have a common terminal and the voltage of the main part of the secondary winding is applied to the first lamp for ignition through both capacitors.

12. The ballast apparatus as claimed in claim 9 in which the main part and the auxiliary part of the secondary winding are directly connected together at a tap and the second capacitor is connected between said tap and said connection extending means and adapted to be connected to a filament of said second lamp.

13. The ballast apparatus as claimed in claim 12 in which said first capacitor and an isolating resistor are connected between said secondary and primary windings.

14. A ballast circuit for igniting and operating two rapid start low wattage lamps in series-sequence from a source of a.c. power of predetermined voltage which comprises:

A. a fixture having first and second low wattage rapid start gaseous discharge lamps mounted therein, B. each of the lamps having a filament mounted in its opposite respective ends, C. a ballast apparatus mounted in said fixture and connected to said lamps and adapted to be connected to said source and including (1) a transformer having an iron core (2) a primary winding mounted on said iron core and a secondary winding mounted on said core, the coupling between the windings being loose enough to provide sufficient leakage reactance in the secondary winding to ballast the lamps when they are operating, (3) the primary winding adapted to be connected across said power source to have the voltage thereof applied to said primary winding, (4) the secondary winding having a main part and an auxiliary part, (5) the primary winding having three closely coupled filament windings, the first filament winding being connected to first filament of the first lamp, the second filament of the first lamp being connected to the first filament of the second lamp whereby the lamps are in series, the second filament being connected to both the second filament of the first lamp and the first filament of the second lamp and the third filament winding being connected to the second filament of the second lamp, (6) a series connection from one end terminal of the secondary winding to the second filament of the second lamp, said terminal being also the end terminal of the auxiliary part of the secondary winding, (7) a first capacitor in series with the secondary winding, (8) at least the secondary winding connected in series with the first capacitor and together therewith forming a loop connected across the lamps in series from the first filament of the first lamp to the second filament of the second lamp and adapted when the primary is energized to furnish operating voltage for both of the lamps in series, (9) a second capacitor,

(10) a series connection between the parts of the secondary winding,

(11) said second capacitor being connected from the last mentioned series connection to the first filament of the second lamp whereby to form a shunting path around the second lamp which includes the auxiliary part of the secondary winding and said second capacitor but does not include said main part of the secondary winding,

(12) the turns ratio of the primary and secondary windings being such that when the primary winding is initially energized the voltage developed in said at least secondary winding but excluding the auxiliary part will be applied through at least the second capacitor to the first lamp by-passing the second lamp and will be sufficient to ignite said first lamp whereby current will pass in said shunting path and generate a voltage in said second capacitor sufficient to ignite the second lamp notwithstanding the presence of said auxiliary part in said shunting path, after which current will flow through said second lamp by-passing the shunting path and as well through said first lamp to form with said at least secondary winding and the said first capacitor a series operating circuit for said lamps,

(13) the number of turns of said auxiliary part being sufficient to provide an inductive reactance in series with said second capacitor to suppress current spikes occurring on half cycles in said second lamp during operation of said ballast circuit.

15. The ballast circuit as claimed in claim 14 in which said at least secondary winding includes only the secondary winding, the primary and secondary winding being connected in straight transformer relationship and being isolated from one another.

16. The ballast circuit as claimed in claim 15 in which the fixture is metal and has the lamps in capacitive voltage starting aid relationship therewith, there being an isolating resistor connected between the second end terminal of said secondary winding and one terminal of the primary winding whereby to generate a starting aid voltage across said isolating resistor, and the second terminal of the primary winding and the metal fixture are grounded.

17. The ballast circuit as claimed in claim 15 in which the capacitors have a terminal in common and the first capacitor is connected in the series connection between the parts of the secondary winding, the voltage being applied in addition through the first capacitor during ignition of the first lamp.

18. The ballast circuit as claimed in claim 15 in which there is an isolating resistor and said first capacitor connected in series between the second end terminal of the secondary winding and the primary winding.

19. The ballast circuit as claimed in claim 14 in which said at least secondary winding includes the primary winding, the primary winding and secondary winding being connected in autotransformer relationship.

20. The ballast circuit as claimed in claim 19 in which the capacitors have a terminal in common and the first capacitor is connected in the series connection between the parts of the secondary winding, the voltage being applied in addition through the first capacitor during ignition of the first lamp.

21. The ballast circuit as claimed in claim 19 in which the primary winding is connected directly to the second terminal of said secondary winding and the first capacitor is in the series connection between said one end terminal of said secondary winding and the second filament of the second lamp.

22. The ballast circuit as claimed in claim 14 in which the capacitors have a terminal in common and the first capacitor is connected in the series connection between the parts of the secondary winding, the voltage being applied in addition through the first capacitor during ignition of the first lamp.

23. The ballast circuit as claimed in claim 14 in which the lamps are 32 watt rapid start T-8 lamps which ignite at high speed and in which the said second capacitor has a capacitance of about 0.1 microfarad.

* * * * *